US007637077B2

(12) United States Patent
Slovik et al.

(10) Patent No.: US 7,637,077 B2
(45) Date of Patent: Dec. 29, 2009

(54) APPLICATING MACHINE

(75) Inventors: Rachell L. Slovik, Bartlett, IL (US); Christopher J. Ludwig, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 40 days.

(21) Appl. No.: 11/789,167

(22) Filed: Apr. 24, 2007

(65) Prior Publication Data

US 2007/0261373 A1 Nov. 15, 2007

Related U.S. Application Data

(60) Provisional application No. 60/799,227, filed on May 9, 2006.

(51) Int. Cl.
*B65B 53/00* (2006.01)

(52) U.S. Cl. ..... 53/48.4; 53/398

(58) Field of Classification Search ..... 53/48.4, 53/48.3, 48.2, 398
See application file for complete search history.

(56) References Cited

U.S. PATENT DOCUMENTS

| | | | | |
|---|---|---|---|---|
| 2,996,025 | A | 8/1961 | Georgeff | |
| 3,032,944 | A | 5/1962 | Henry et al. | |
| 3,816,968 | A | 6/1974 | Morgan et al. | |
| 3,959,949 | A | 6/1976 | Benno et al. | |
| 3,991,640 | A | 11/1976 | Schlueter | |
| 4,250,682 | A | 2/1981 | Braun | |
| 4,324,085 | A | 4/1982 | Olsen | |
| 4,501,104 | A | 2/1985 | Griffin et al. | |
| 5,054,257 | A | 10/1991 | Cunningham et al. | |
| 5,117,609 | A | 6/1992 | Seymour et al. | |
| 5,365,721 | A | 11/1994 | Focke | |
| 5,383,321 | A | 1/1995 | Krogman et al. | |
| 5,542,231 | A | 8/1996 | Ungar et al. | |
| 5,813,193 | A | 9/1998 | Chan et al. | |
| 6,122,893 | A | 9/2000 | Weaver et al. | |
| 6,170,225 | B1 | 1/2001 | Cervantes et al. | |
| 6,272,816 | B1 * | 8/2001 | Viaud et al. | 53/587 |
| 6,588,173 | B1 | 7/2003 | Moore et al. | |
| 6,973,760 | B2 | 12/2005 | Moore | |
| 7,334,382 | B2 * | 2/2008 | Smith | 53/430 |

FOREIGN PATENT DOCUMENTS

| | | |
|---|---|---|
| EP | 0 084 442 | 7/1983 |
| EP | 1 207 105 | 11/2001 |
| EP | 1 495 969 | 1/2005 |
| WO | WO 03/016144 | 2/2003 |

OTHER PUBLICATIONS

ITW Hi-Cone 2000MPA-III Service Manual, Nov. 15, 1999.
ITW Hi-Cone Model 2000 MPA Multipackaging Machine, product information sheets, 2 pages, 2000.

* cited by examiner

*Primary Examiner*—Hemant M Desai
(74) *Attorney, Agent, or Firm*—Pauley Petersen & Erickson

(57) ABSTRACT

An applicating machine for applying a flexible carrier to a plurality of containers provided from an infeed includes a jaw drum moveable between an operating position and a storage position away from the operating position. In the operating position the jaw drum is positioned with respect to the infeed to accept the plurality of containers and apply the flexible carrier to the plurality of containers. A second jaw drum may be moveable into the operating position to enable packaging of containers having different dimensions and/or packages having different configurations.

20 Claims, 10 Drawing Sheets

APPLICATING MACHINE

CROSS REFERENCE TO RELATED APPLICATION

This patent application claims the benefit of U.S. Provisional Application No. 60/799,227, filed 9 May 2006.

BACKGROUND OF THE INVENTION

1. Field of the Invention

This invention relates to a machine for unitizing a plurality of containers using a flexible container carrier.

2. Description of Prior Art

Container carriers connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes along various points along the sidewall or under the chime of the container. A preferable machine would be capable of application of a container carrier to a wide range of container sizes in a number of different package sizes in one of several positions along the container sidewall and/or chime.

Prior art multi-packaging devices and methods generally require several different versions or configurations of machines to accommodate different container carrier, package sizes and package configurations. Machines are traditionally a limitation on the range of container diameters, size of package or configuration of package that can be effectively packaged by a single system.

In addition, different machines or complex set-up procedures would also be required for different sizes of packages, for instance 4-packs, 6-packs and/or 12-packs. Each different package size would typically require different machines and/or complex set-up of machine configurations to accommodate division and diversion of differently sized packages.

Finally, different machines or complex set-up procedures would also be required for containers having different heights or requiring application along different points along the container sidewall and/or chime. Two traditional configurations of container carrier to container are the sidewall-applied carrier (SAC) position and the rim-applied carrier (RAC) position. A sidewall-applied carrier requires that the carrier is applied lower along the container than the rim-applied carrier. In addition, containers having different heights typically require positioning of the carrier along different heights of the sidewall. As such, different machines and/or set-up procedures are traditionally required to bring the carrier up or down along the container. Likewise, such different equipment and/or set-up procedures are traditionally required to package containers having different overall heights.

Conventional applicating machines include a single jaw drum used to apply carriers to individual containers. The conventional jaw drum is typically fixed into position on the applicating machine and used in connection with a fixed range of container diameters, such as a range of approximately 0.2 inches and up to a range of approximately 0.5 inches, based upon the size of the jaw drum. Such conventional applicating machines typically include an infeed conveyor for supplying a plurality of containers within a limited range of diameters to the jaw drum. Additionally, a reel stand is positioned upstream of the jaw drum to supply a reel of carriers to a feed drum and then on to the jaw drum.

The string of carriers are then traditionally applied to the containers and, following application, cut into a desired package configuration. The resulting package is then fed into a turner-diverter that moves and/or rotates the package to a correct position for placement on a pallet or similar shipping unit.

Accordingly, an entirely distinct applicating machine is typically required when packaging a second plurality of containers outside of a size range that can be accommodated with the standard applicating machine.

SUMMARY OF THE INVENTION

It is one object of this invention to provide a machine that combines speed, flexibility, quick changeover and ease of operation and maintenance.

It is another object of this invention to provide a machine for unitizing a plurality of containers having a range of possible container heights, diameters and/or sizes.

According to one preferred embodiment of this invention, a machine for packaging multiple containers includes one or more jaw drums moveable between a storage position out of line with the machine and an operating position inline with the machine. When a changeover is desired, a first jaw drum is moveable from an operating position to a storage position and a second jaw drum is moveable from either the same or different storage position to the operating position.

As such, according to a preferred method of operation of the subject invention, the machine utilizes a first jaw drum and a second jaw drum. Containers having a first diameter are provided to the machine having the first jaw drum in the operating position. A first carrier stock is moved through the machine and positioned over the containers having the first diameter to form the first unitized package. Next, should a different style, size and/or configuration of package be desired, a second jaw drum is moved from the storage position into the operating position with the first jaw drum and containers having the second diameter are provided to the machine. A second carrier stock is then moved through machine and positioned over the containers having the second diameter to form the second unitized package. In this manner, an operator can use a single machine to package a wide range of containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
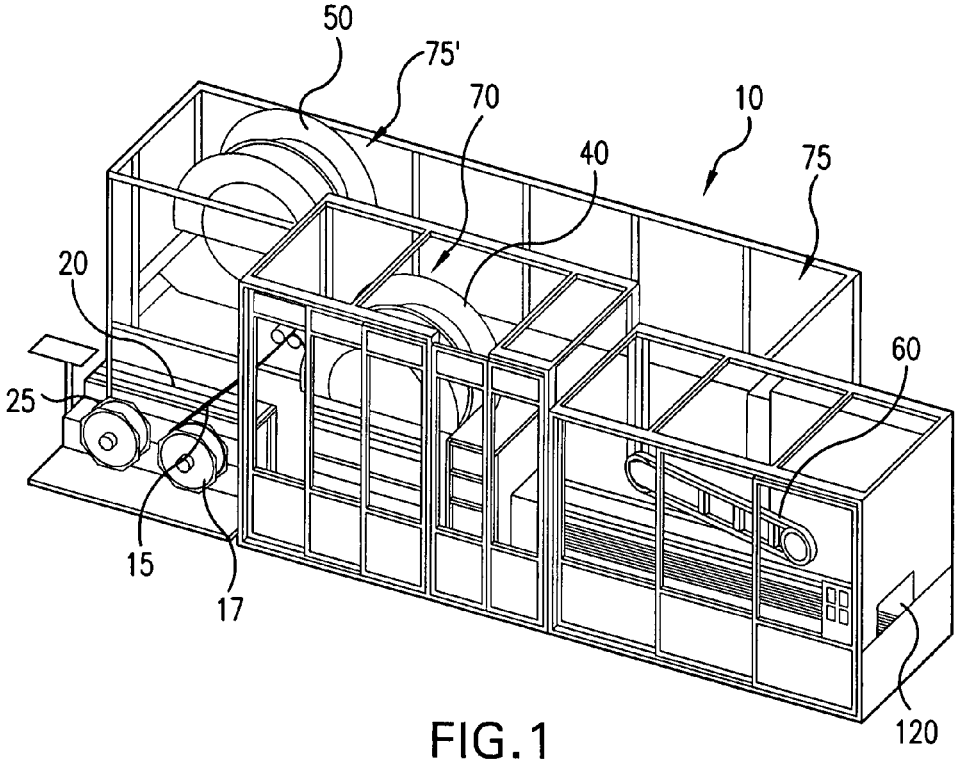
FIG. 1 is a perspective view of a machine according to one preferred embodiment of this invention.
Figure 2:
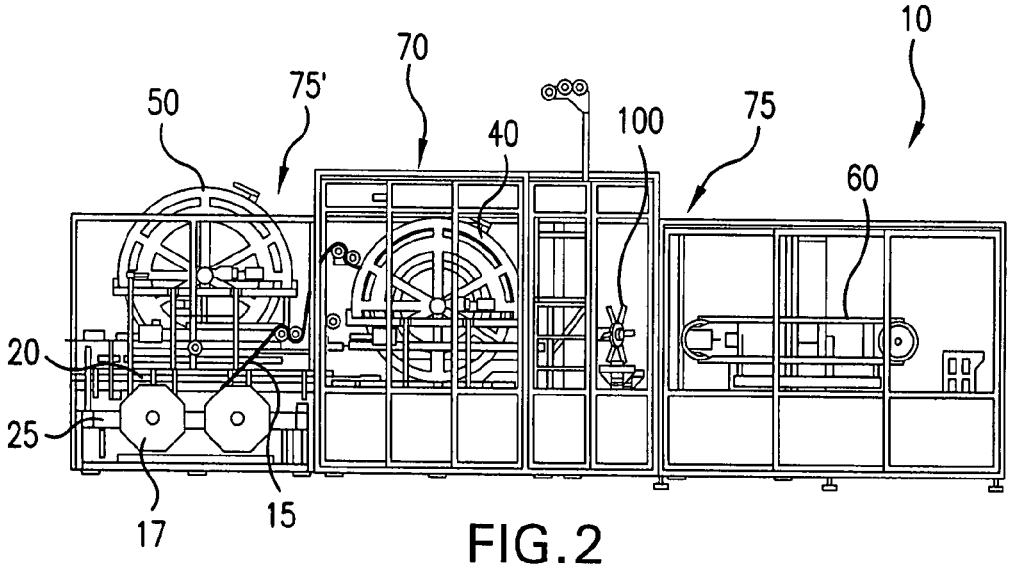
FIG. 2 is a side view of the machine shown in FIG. 1.
Figure 3:
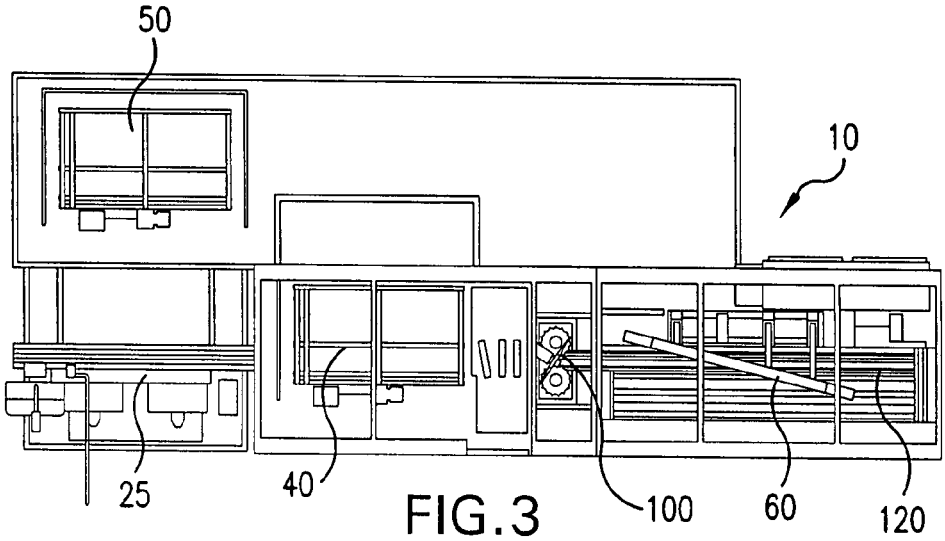
FIG. 3 is top view of the machine shown in FIG. 1.

FIGS. 1-13 show a system and machine for packaging multiple containers in a carrier according to one preferred embodiment of this invention. As shown in FIGS. 1-3, carrier stock 15 moves through machine 10, specifically through jaw drum 40, where it is applied to containers and then separated into individual, unitized packages. According to one preferred embodiment of this invention, if a uniform group of like-sized containers having a different size requires packaging and/or if a package is required having a different configuration and/or if a different carrier is required, a separate machine is unnecessary as machine 10 may be quickly reconfigured, following various adjustments to machine 10, as described below.

Therefore, the machine 10 for packaging multiple containers in multiple size packages along multiple locations on the container sidewall according to this invention permits the use of a single machine in combination with a variety of sizes of containers, sizes of packages and configurations of packages. Traditional machines are typically fifteen or more feet long and six or more feet wide, therefore a reduction in the number of machines required in a packaging plant significantly reduces the required working floor space within the plant. In addition, quick and generally toolless set-up and changeover results in more efficient packaging operations.

Carrier stock 15 preferably moves through machine 10 from reel stand 25 where carriers are dispersed in a continuous string of carrier stock 15 and ultimately to packages where each carrier is separated into a unitized package, each package containing a plurality of uniform containers. A typical configuration for a package is a "six-pack" containing two longitudinal rows of containers in three transverse ranks. Additional desired packages such as four-packs, eight packs and twelve packs may be unitized using machine 10 according to this invention, and such additional sizes of packages are limited only by the consumer market for such additional sizes.

Carrier (and carrier stock) is preferably constructed from a flexible plastic sheet, such as low-density polyethylene. The flexible plastic sheet is punched or otherwise formed into a plurality of container receiving apertures aligned in transverse ranks and at least two longitudinal rows to form a continuous sheet of carriers.

According to one preferred embodiment of this invention, machine 10 for packaging multiple containers includes moving carrier stock 15 through machine 10 from reel stand 25. Carrier stock 15 then enters machine 10 into jaw drum 40 (also referred to as "first jaw drum 40" herein). Following application to containers, carrier stock 15 is divided into individual carriers using cut-off wheel 100 resulting in individually unitized packages of a desired size which are then dispersed to a case packer (not shown), for example, by using turner/diverter 60.

Figure 5:
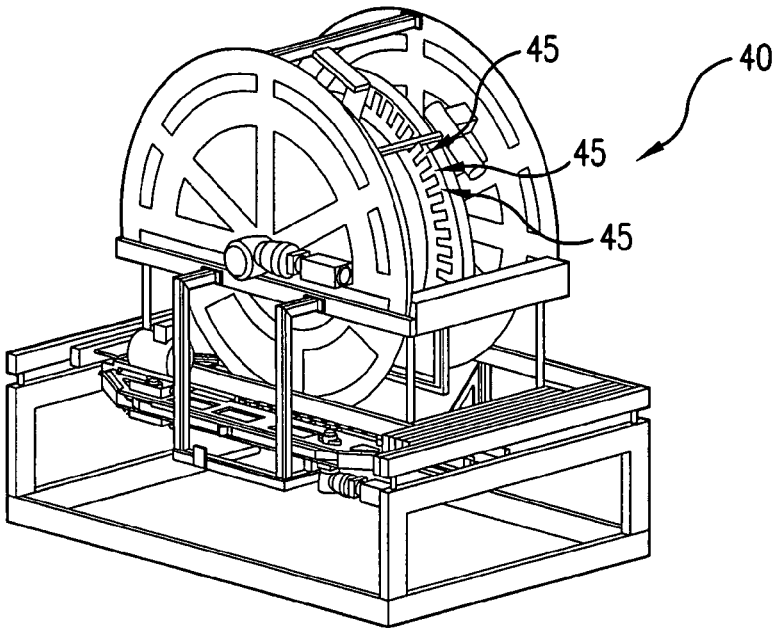
FIG. 5 is a perspective view of jaw drum according to one preferred embodiment of this invention.
Figure 6:
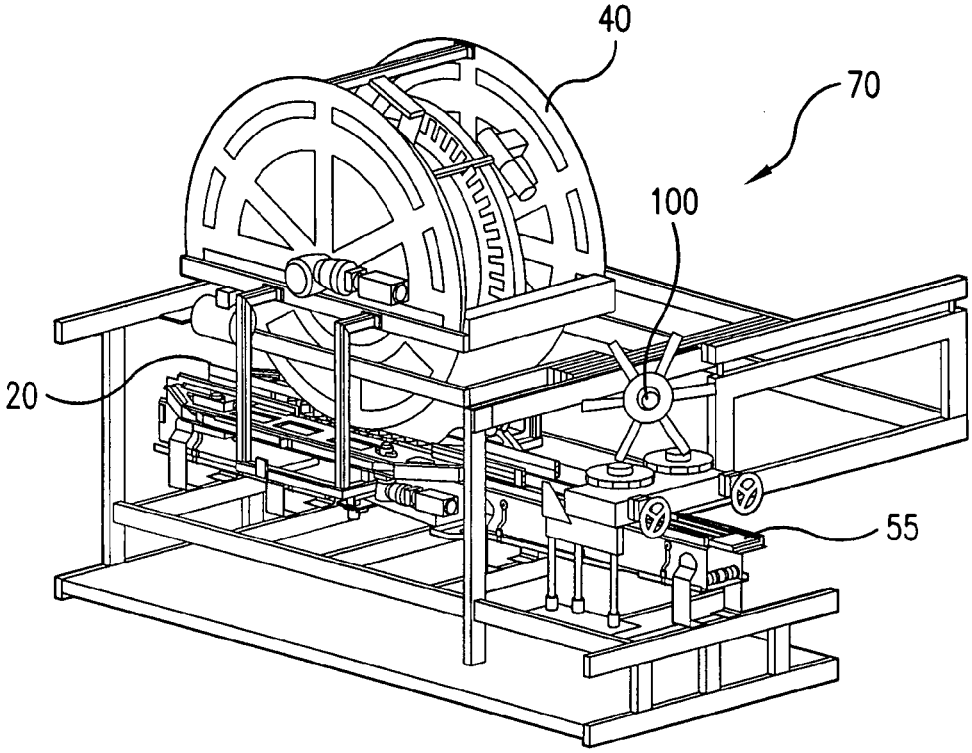
FIG. 6 is a perspective view of the jaw drum shown in FIG. 5 positioned in an operating position.

According to a preferred embodiment of this invention, a plurality of containers each having a different diameter may also be packaged using the same machine 10. According to a preferred embodiment of this invention, when a changeover is desired, first jaw drum 40, such as shown in FIG. 5, is moved from an operating position 70 inline with carrier stock 15, such as shown in FIG. 6, to a storage position 75 not inline with carrier stock 15. Additionally, second jaw drum 50 is moved from a storage position 75' to the operating position 70. Carrier stock 15, typically having a new configuration to accommodate the different diameter, is then fed into second jaw drum 50 as previously described and multiple containers with the different diameter are then similarly packaged. As used herein, the term "inline" means that the respective jaw drum is positioned to receive and apply carrier stock 15 to containers.

As such, according to a preferred method of operation of the subject invention, that is, a method of packaging multiple containers in unitized packages wherein a first unitized package includes containers having a first diameter and a second unitized package includes containers having a second diameter, machine 10 utilizes first jaw drum 40 and second jaw drum 50. Containers having the first diameter are provided to machine 10 having first jaw drum 40 in the operating position 70. A first carrier stock 15 is moved through machine 10 and positioned over the containers having the first diameter to form the first unitized package. First jaw drum 40 is then moved to storage position 70 of machine 10 not inline with carrier stock 15. Next, second jaw drum 50 is moved from the storage position 75' into the operating position 70 and containers having the second diameter are provided to machine 10. A second carrier stock (not shown) is then moved through machine and positioned over the containers having the second diameter to form the second unitized package.

In this manner, an operator can use a single machine to package a wide range of containers. Specifically, it is desirable that machine 10 is capable of packaging containers within a diameter range of approximately 2 inches to approximately 3 inches, more specifically between approximately 2.3 inches and approximately 2.9 inches. In addition, it is desirable that machine 10 is capable of packaging containers within a height range of approximately 4 inches to approximately 12 inches, more specifically between approximately 4.75 inches and approximately 11 inches.

According to a preferred embodiment of this invention, machine 10 is capable of packaging between 1500 and 1800 containers per minute. It is desirable that machine 10 may be reconfigured between jaw drums within approximately 15 minutes.

One ore more operative components of machine 10 are preferably adjustable to permit packaging of containers having different sizes, such as heights and diameters, carriers having different sizes, packages having different sizes, such as six-packs and twelve-packs, and packages having different configurations, namely rim-applied carrier (RAC) configurations and side-applied carrier (SAC) configurations. In each of these different applications, multiple components of machine 10 may be adjusted, replaced and/or interchanged to permit application of carrier stock to containers. Several of these components are described in more detail below.

Reel Stand

Figure 7:
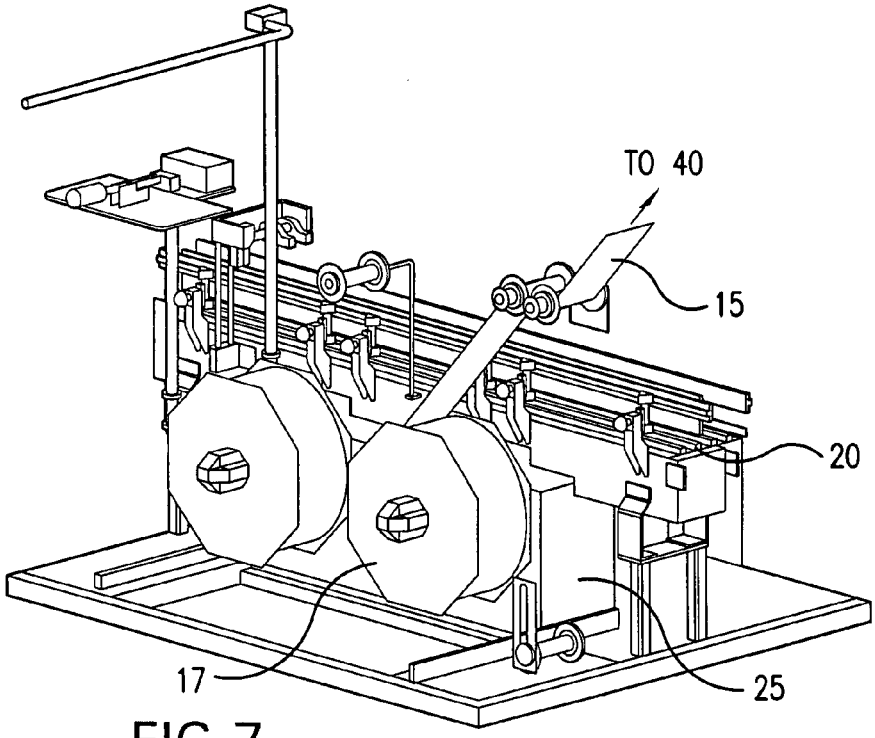
FIG. 7 is a perspective view of a reel stand in a first position.
Figure 8:
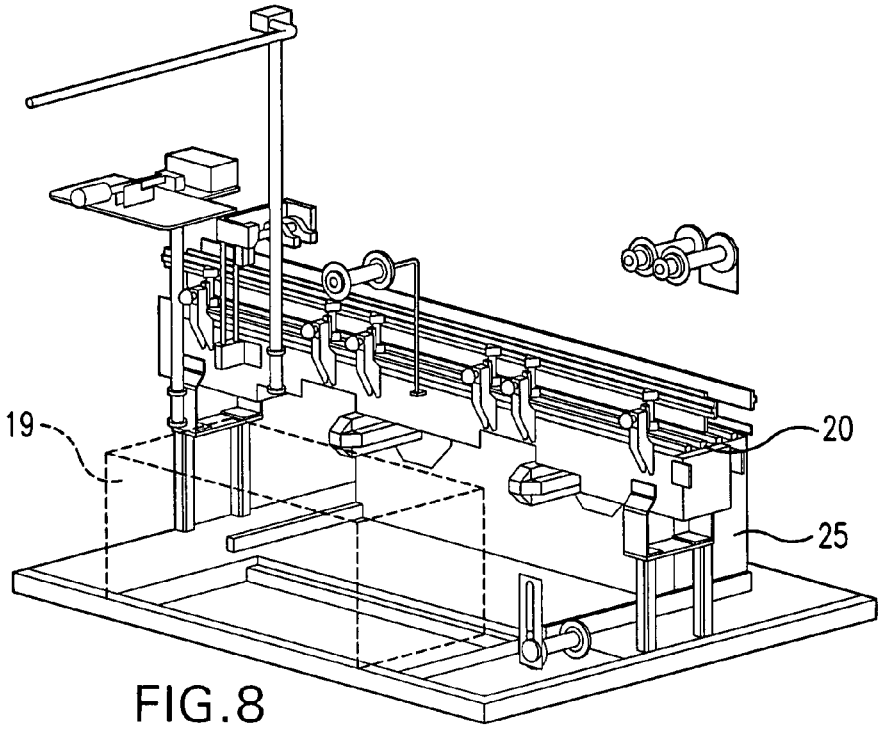
FIG. 8 is a perspective view of the reel stand shown in FIG. 7 in a second position.

As shown in FIGS. 7 and 8, reel stand 25 is positioned at an infeed end of machine 10. Reel stand 25 preferably accommodates reels 17 of rolled carrier stock or cartons 19 of fan folded carrier stock, depending upon the desired configuration.

Carrier stock 15 is preferably dispersed from reel stand 25 to an operating position of jaw drum 40 in a generally continuous manner. As shown in FIG. 7, two reels 17 of carrier stock 15 are preferably positioned within reel stand 25 so that as one reel 17 is exhausted, the other reel 17 may be spliced into position to enable a generally continuous flow. Alternatively, as shown in FIG. 8, a carton 19 of fan folded carrier stock 15 may be positioned relative to reel stand 25 to permit generally continuous flow of stacks of fan folded carrier stock 15.

Accordingly, depending on the desired format of carrier stock 15, reel stand 25 is preferably moveable between a first position for accommodating reels 17 of carrier stock 15 and a second position permitting placement of carton 19 of carrier stock 15 relative to machine 10.

Infeed Conveyor

Figure 9:
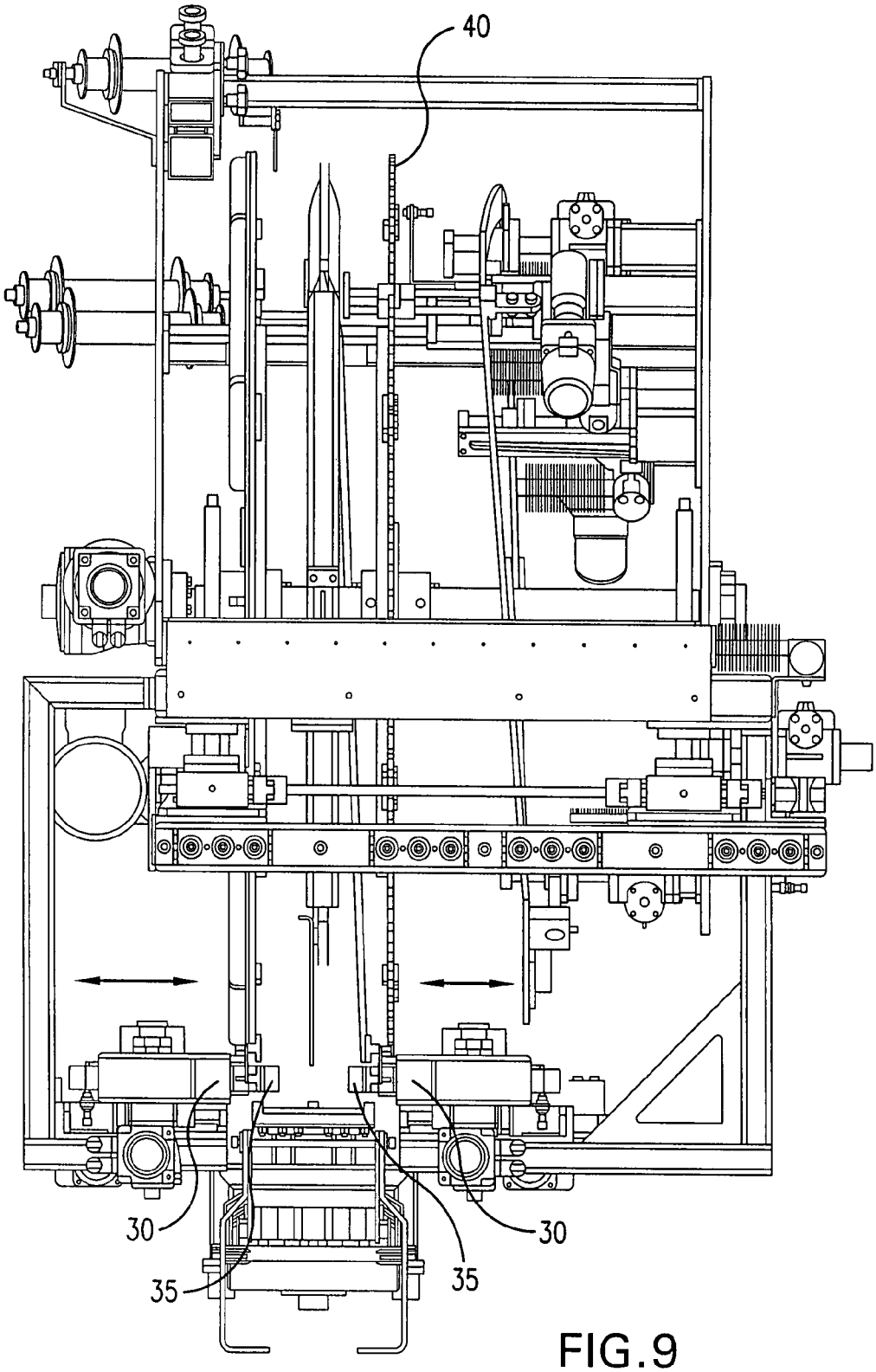
FIG. 9 is a front view of an infeed conveyor according to one preferred embodiment of this invention.
Figure 10:
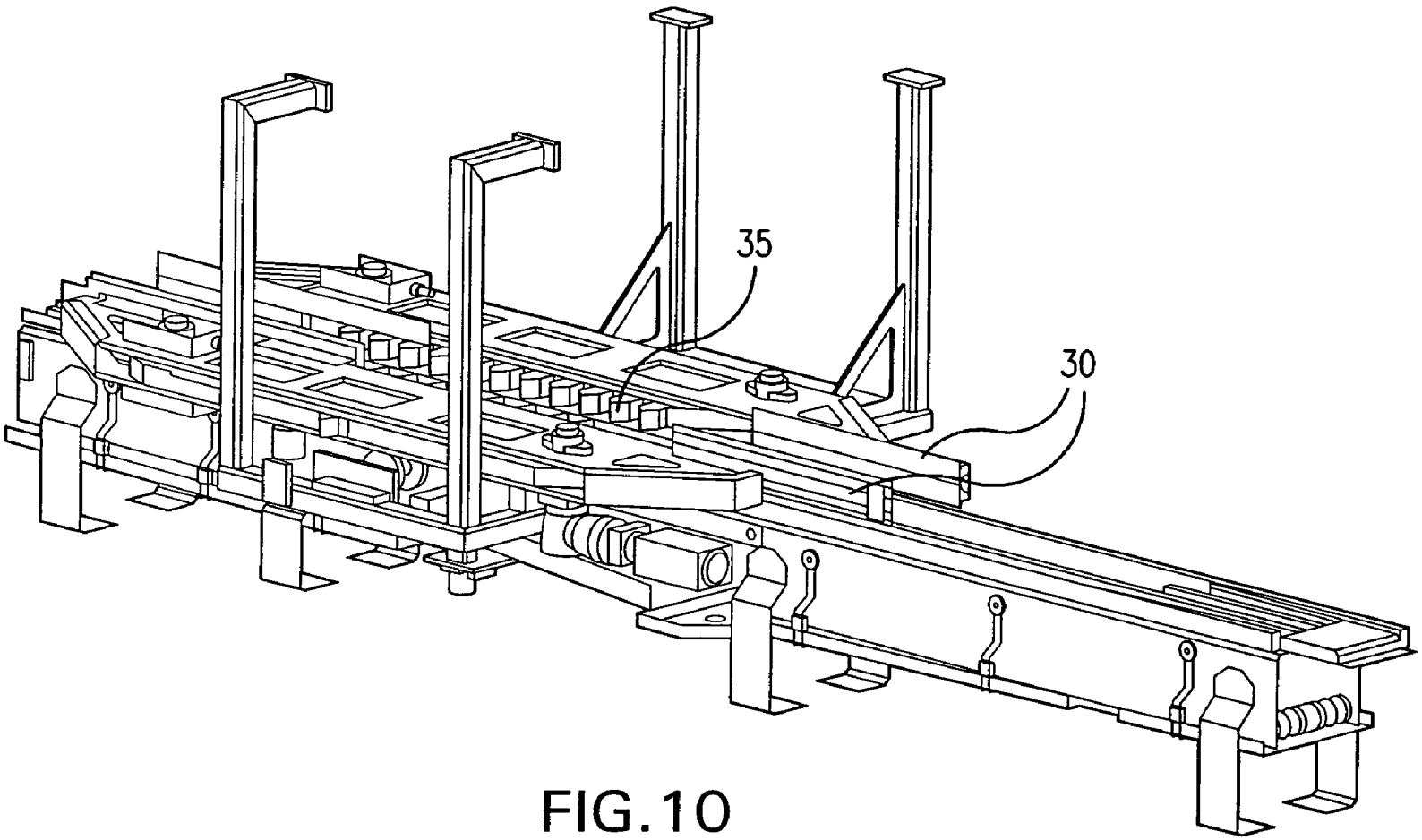
FIG. 10 is a perspective view of the infeed conveyor shown in FIG. 9.

As shown in FIGS. 7 and 8, infeed conveyor 20 may extend generally through reel stand 25. Infeed conveyor 20 is preferably positioned to convey containers longitudinally into a platform of machine 10, in preferably two longitudinal rows. According to a preferred embodiment of this invention and as shown in FIGS. 9 and 10, a pair of sidewalls 30 are positioned along infeed conveyor 20 between which containers pass beneath jaw drum 40, 50. Sidewalls 30 are preferably adjustable relative to each other depending upon a size of container to be packaged.

Infeed conveyor 20 may further include infeed lug centerline adjustability to accommodate a group of containers having a different diameter. As a result, the distance between sidewalls 30 in infeed conveyor 20 may be adjustable by adjusting a distance between opposing sets of lugs 35. Infeed conveyor 20 may further comprise a plurality of lugs 35 extending along sidewalls 30. Lugs 35 preferably move relative to sidewalls 30 to positively guide containers into position below jaw drum 40, 50. Accordingly, the plurality of containers move through machine 10 and each container is spaced apart from an adjacent container by lugs 35. The spacing between adjacent containers as they enter machine 10 depends upon the relative sizing of lugs 35 which are preferably sized to accommodate the largest diameter container to be used in machine 10.

A relative position of sidewalls 30 and/or configuration of lugs 35 may be adjustable and/or replaceable to accommodate varying and/or non-conventional container shapes, such as contoured bottles. As discussed in more detail below, carrier stock 15 is subsequently positioned over the plurality of containers whereby each container receiving aperture engages with one of the containers to form a package having a predetermined number of containers.

Jaw Drums

Accordingly, a plurality of containers is provided from infeed conveyor 20 to jaw drum 40, 50 for application of carrier stock 15 to containers. As described, jaw drum 40 or second jaw drum 50 may be positioned in an operating position 70 with respect to infeed conveyor 20 to accept the plurality of containers. The following detailed description presumes use of jaw drum 40 (or "first jaw drum 40") in the operating position 70, however, second jaw drum 50 preferably operates in the same or similar manner as jaw drum 40 described.

Carrier stock 15 proceeds from reel stand and/or infeed to jaw drum 40, particularly to jaw pairs 45 located radially about jaw drum 40. Jaw drum 40 preferably comprises a cylindrical member rotatable about a horizontal axis which transports carrier stock 15 to the plurality of containers which flow through jaw drum 40. A plurality of jaw pairs 45 are preferably equally spaced around a perimeter of jaw drum 40. Radial positions of jaw pairs 45 around the perimeter of jaw drum 40 are preferably permanently fixed.

As best shown in FIG. 5, according to one preferred embodiment of this invention, each jaw pair 45 comprises a fixed jaw and a moveable jaw (not shown). In one preferred embodiment of this invention, jaw pairs 45 are moved between an open position and a closed position. According to one preferred embodiment of this invention, each fixed jaw is aligned around one perimeter edge of jaw drum 40 and each moveable jaw is aligned opposite each corresponding fixed jaw. Each resulting jaw pair 45 is preferably spaced equidistantly around the perimeter of jaw drum 40 from each other jaw pair 45.

Each jaw pair 45 is configured to grip carrier stock 15 with the moveable jaw and the fixed jaw engaged through each transverse pair of container receiving apertures in carrier stock 15. The circumferential spacing between adjacent jaw pairs 45 is preferably approximately equal to a pitch of carrier, i.e., the distance between adjacent centers of container receiving openings. The lateral spacing between the moveable jaw and the fixed jaw in the closed position is preferably slightly less than a width between transverse pairs of container receiving apertures. Carrier stock 15 is engaged with jaw pairs 45 of jaw drum 40 immediately prior to application to containers.

As jaw pairs 45 move with the rotation of jaw drum 40, container receiving apertures within carrier stock 15 stretch to accommodate a container. Carrier stock 15 in a stretched condition is positioned over a plurality of containers so that each container receiving aperture engages with one container. Upon engagement with the containers, carrier stock 15 is released from jaw pair 45 and grips a perimeter of container, either around a chime in a rim-applied carrier (RAC) configuration or, more preferably, around a sidewall in a sidewall-applied carrier (SAC) configuration.

Jaw drum 40 is preferably adapted to move between the operating position 70 and a storage position 75. Second jaw drum 50 is likewise adapted to move between the operating position and a storage position 75'. Although shown in FIGS. 2-4 and described herein as different storage positions 75, 75', jaw drum 40 and second jaw drum 50 may share a common storage position that may be adaptable to enable transfer between the operating position 70 and storage position 75. Jaw drums 40, 50 may be moved individually or as a module that includes other components of machine 10, such as cutoff wheel 100 and/or other operative components.

According to a preferred embodiment of this invention, one or more rails or tracks 80 extend between the operating position 70 and the storage position 75, 75'. Jaw drum 40 and/or module containing jaw drum 40 may thereby slide on track 80 between operating position 70 and storage position 75. Likewise, second jaw drum 50 and/or module containing second jaw drum 50 may slide on track between operating position 70 and storage position 75'. Jaw drums 40, 50 may be positioned on or with respect to linear bearings to permit movement along rails or tracks 80.

Figure 4:
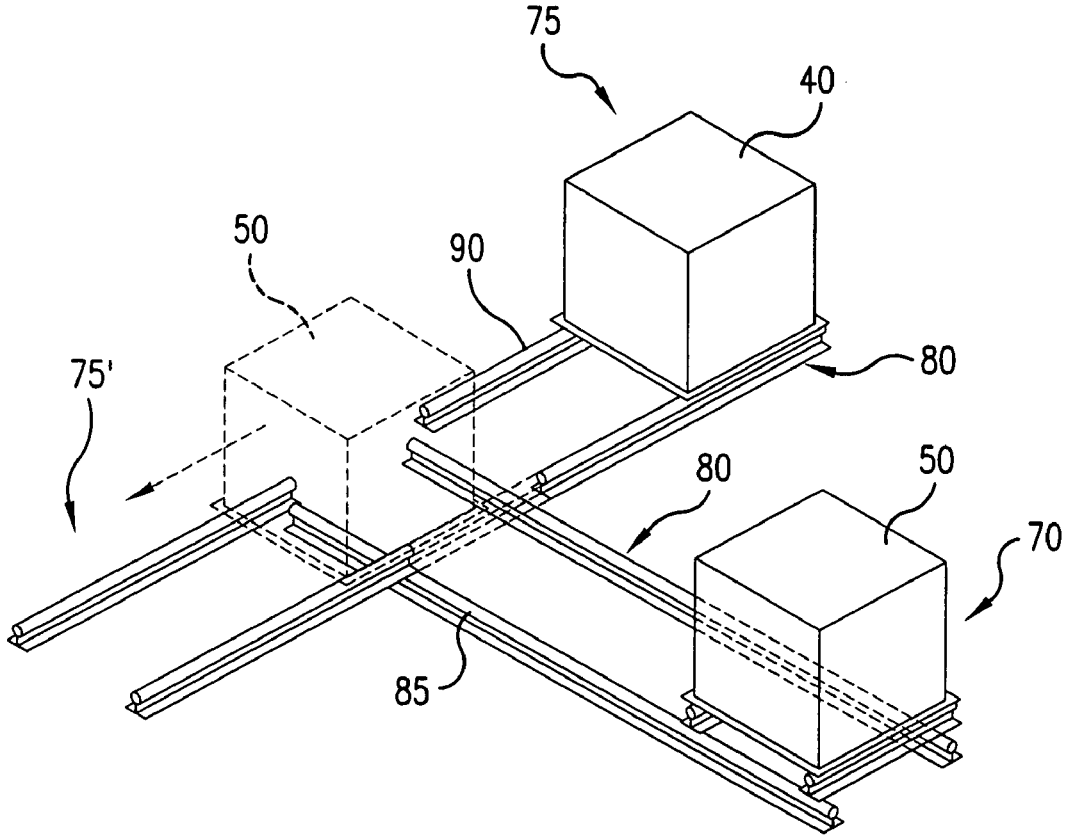
FIG. 4 is a schematic of two interchangeable modules according to one preferred embodiment of this invention.

More specifically, according to one preferred embodiment of this invention shown schematically in FIG. 4, first track 85 may extend from operating position 70 within machine 10. Second track 90 may further extending generally perpendicular to first track 85, preferably to form a 'T', so that first track 85 intersects second track 90 at junction 95. Storage position 75 may be positioned on one side of junction 95 and storage position 75' may be positioned on opposite side of junction 95. In this manner, jaw drum 40 and jaw drum 50 may be slid or otherwise moved into operating position 70 without removal of jaw drums 40, 50 from track 80 and/or machine 10.

Jaw drum 40 and second jaw drum 50 are preferably used in connection with different sets of containers and/or carriers. For example, according to one preferred embodiment of this invention, jaw drum 40 includes a different pitch between jaw pairs 45, that is, jaw pairs 45 are circumferentially spaced at a different pitch length, than second jaw drum 50. For example, jaw drum 40 may include a pitch between adjacent jaw pairs 45 of approximately 3 inches and the second jaw drum 50 includes a pitch between adjacent jaw pairs 45 of approximately 2.6 inches. As a result, jaw drum 40 may be used to package containers having a diameter of approximately 3.0 inches and second jaw drum 50 may be used to package containers having a diameter of approximately 2.6 inches.

First jaw drum 40 and second jaw drum 50 are preferably interchangeable between the operating position and the storage position without the use of tools, such as with locking levers which may be loosened by hand to permit sliding jaw drums 40, 50 relative to tracks and/or rails.

Figure 11:
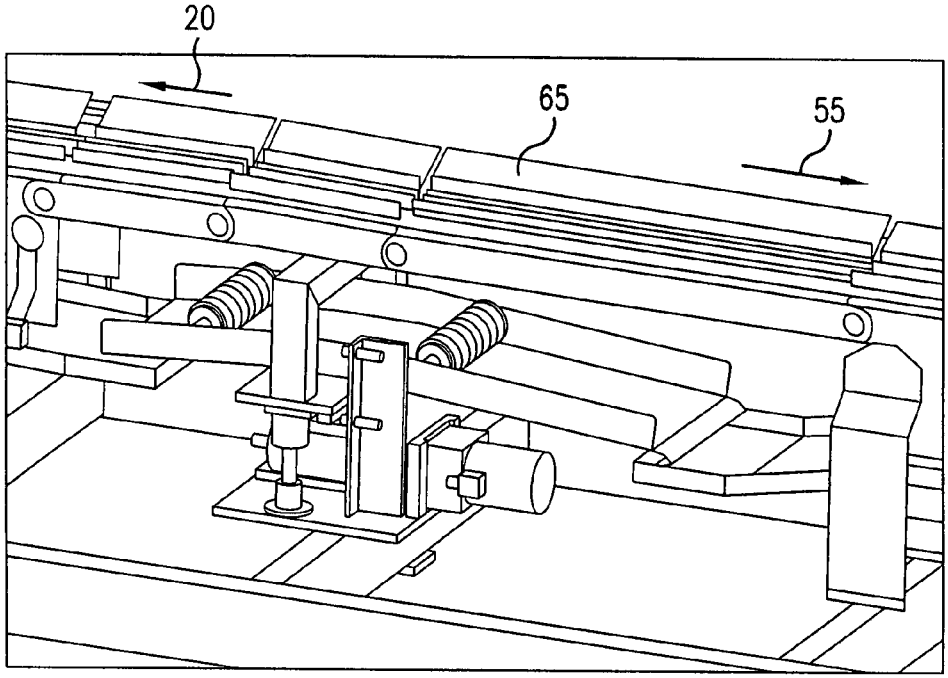
FIG. 11 is a perspective view of an adjustable platform positioned beneath a jaw drum according to one preferred embodiment of this invention.

To further accommodate various containers, specifically those having different heights, infeed conveyor 20 may be lowered or raised relative to jaw drum 40, 50 so that jaw pairs 45 are positioned lower along the container to facilitate placement of carrier stock 15 around the sidewall of containers having different heights. Specifically, such as shown in FIG. 11, platform 65 may be positioned beneath the operating position 70 of a respective jaw drum 40, 50 so that at least one of a vertical height and angle of the plurality of containers is adjustable relative to the operating position 70. Platform 65 is preferably positioned integrally or inline with infeed conveyor 20 and output conveyor 55. According to one preferred embodiment of this invention, platform 65 is adjustable to accommodate containers having heights between approximately 4 inches and approximately 12 inches or more specifically between 4.75 inches and 11 inches.

Cutoff Wheel

Figure 12:
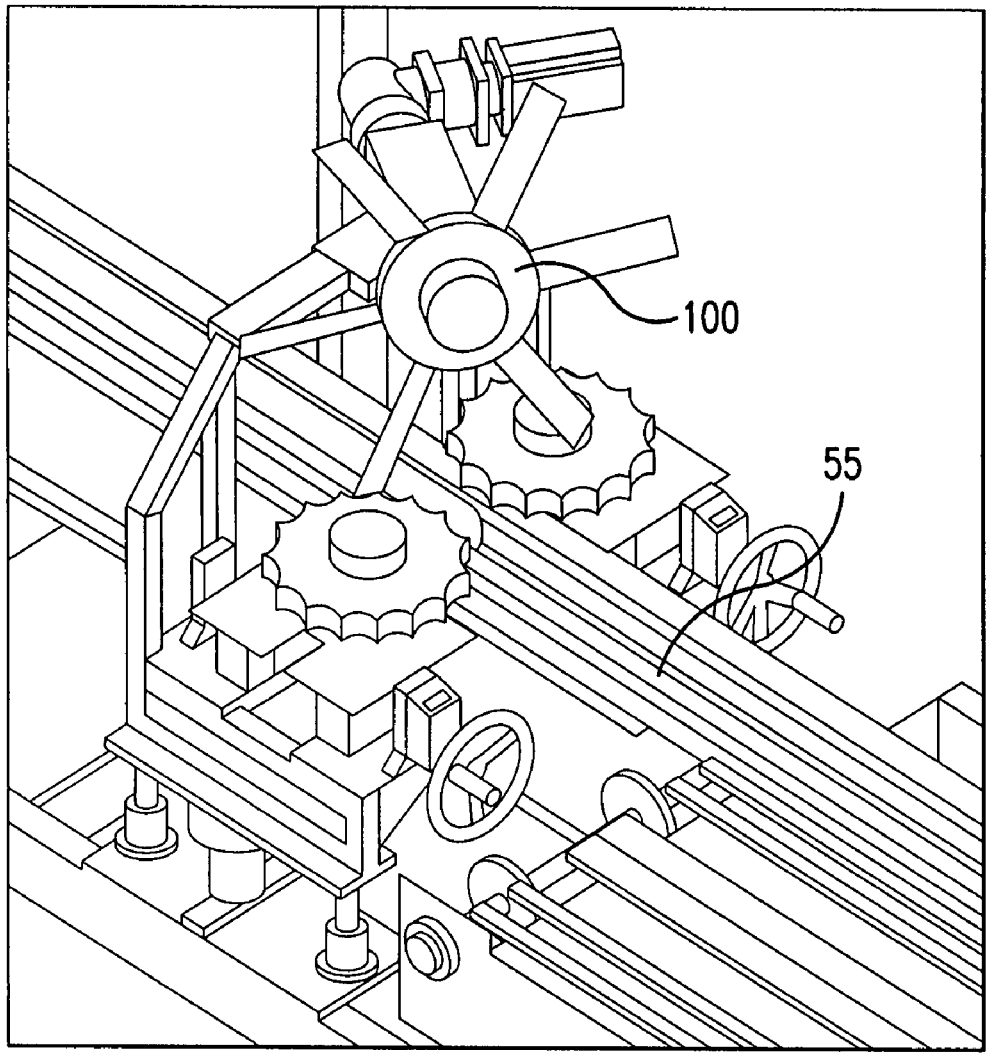
FIG. 12 is a perspective view of a cutoff wheel according to one preferred embodiment of this invention.

Output conveyor 55 preferably conveys the containers longitudinally from platform 65 and/or infeed conveyor 20 after carrier stock 15 has been applied After carrier stock 15 is stripped from jaw pairs 45, a continuous string of unitized containers proceeds along output conveyor 55 and through cutoff wheel 100, such as shown in FIG. 12. According to a preferred embodiment of this invention, cutoff wheel 100 is adjustable and/or replaceable with minimal use of tools to divide packages into any number of desired sizes.

Cutoff wheel 100 preferably includes a plurality of knives positioned around a perimeter of cutoff wheel 100 at appropriate increments based upon a desired size of the package. For instance, if a six-pack is desired, knives are positioned in between every three containers to cut carrier stock 15 into packages having three ranks of two rows of containers. Likewise, if an eight-pack is required, knives are positioned in between every four containers to cut carrier stock 15 into packages having four ranks of two rows of containers.

The knives are preferably removable and/or adjustable within cutoff wheel 100 preferably using methods that provide quick and efficient removability and replaceability. Alternatively, the entire cutoff wheel 100 may be replaceable to account for different package configurations.

Turner/Diverter

Figure 13:
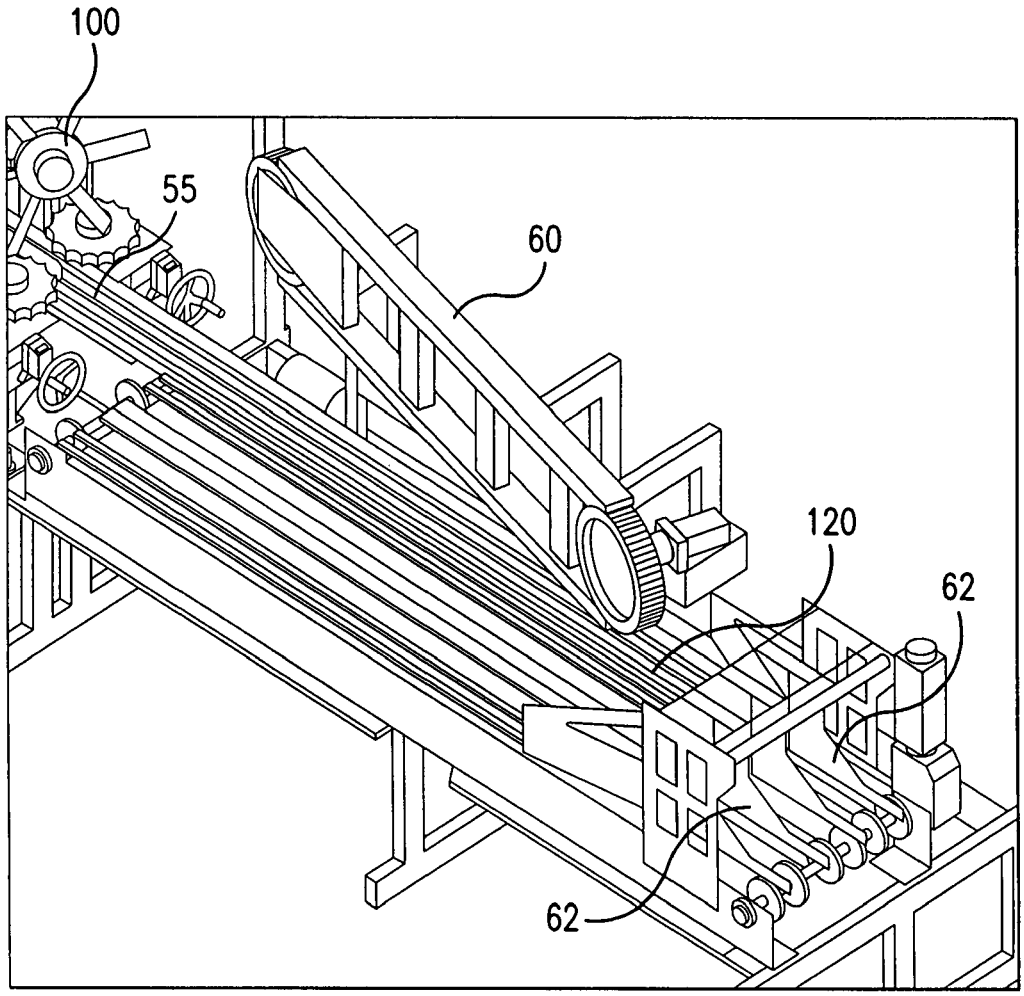
FIG. 13 is a perspective view of a turner/diverter according to one preferred embodiment of this invention.

An outfeed such as output conveyor 55 subsequent provides individual unitized packages of containers from the operating position 70 to turner-diverter 60, such as shown in FIG. 13. Turner/diverter 60 is preferably positioned over discharge conveyor 120 and is used to move, align and/or realign the individual packages into a desirable discharge pattern for placement by a case packer into boxes and/or pallets and/or other shipping containers. For example, turner/diverter 60 may be used to rotationally realign six-packs from a two wide position as they emerge from the cutoff wheel 100 to a three wide position and on to a case packer to place in corrugated cardboard trays.

Turner/diverter 60 preferably includes a plurality of lugs extending from a continuous belt. The lugs may be removable and/or replaceable to accommodate various sizes and configurations of packages.

Turner/diverter 60 and/or discharge conveyor 120 are preferably adjustable up and down relative to each other, such as by using one or more linear actuators controlled electronically and/or manually. Adjustment of linear actuators enable turner/diverter 60 to properly address packages of different heights. In addition, discharge guides 62 may be removeable and replaceable to enable different discharge patterns.

Machine Drive

According to one preferred embodiment of this invention, one or more of the operative components of machine 10 preferably includes an associated drive, either electrical or mechanical. The associated drive may include a servo motor providing power and feedback or a simple motor providing only power. According to one preferred embodiment of this invention, a drive electrically connects one component of machine 10 with respect to at least one other component of machine 10 including jaw drums 40, 50, infeed conveyor 20, reel stand 25, turner/diverter 60 and/or cutoff wheel 100.

According to a preferred embodiment of this invention, a drive speed of each moving component of machine 10 is timed and maintained using suitable electronic controls. Additionally or alternatively, various heights of individual components of machine 10 may be maintained using such suitable electronic controls. A controller, such as a PLC, is preferably electrically connected to a suitable moving component of machine 10, for instance to jaw drums 40, 50, reel stand 25, infeed conveyor 20 and/or turner/diverter 60 resulting in coordinated movements of these mechanisms relative to each other. As described herein, each referenced component (jaw drum 40, feed drum 70, etc.) may include a corresponding motor that powers a respective drive of such referenced component.

As a result, jaw drum 40, 50 may be registered relative to a home position of a container based upon signals received from the controller. Likewise, turner/diverter 60 preferably operates to position packages along discharge conveyor 120 at a speed and/or height responsive to signals received from the controller. As a result of the described relationship among the various drive mechanisms in machine 10, various mechanical adjustments are unnecessary among such drive mechanisms when switching between different jaw drum 40, 50, different containers, different carriers, different package configurations and other changes that may result in a change in operating characteristics of machine 10.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. An applicating machine for applying a flexible carrier to a plurality of containers provided from an infeed, the applicating machine comprising:

an operating position inline with the flexible carrier;

a first track extending from the operating position;

a storage position not inline with the flexible carrier;

a first jaw drum releasably positioned in the operating position with respect to the infeed to accept the plurality of containers, the first jaw drum applying the flexible carrier to the plurality of containers, the first jaw drum capable of being released from the operating position and slideably interchangeable between the operating position and a position on the machine not inline with the flexible carrier;

a second jaw drum positioned in the storage position and slideably interchangeable between the storage position and the operating position, the second jaw drum slideable to the operating position after the first jaw drum is removed therefrom; and a second track extending from the first track, the first track intersecting the second track at a junction, wherein the storage position of the first jaw drum is on an opposite side of the junction as the storage position of the second jaw drum.

2. The applicating machine of claim 1 wherein the first jaw drum and the second jaw drum each include a plurality of jaw pairs, the jaw pairs from the first jaw drum having a different pitch between jaw pairs from the second jaw drum.

3. The applicating machine of claim 1 further comprising a first set of rails for sliding the first jaw drum relative to the operating position.

4. The applicating machine of claim 3 further comprising a second set of rails for sliding the second jaw drum relative to the operating position.

5. The applicating machine of claim 1 wherein the first jaw drum is positionable in a first storage position and the second jaw drum is positionable in a second storage position, each of the first jaw drum and second jaw drum slideable with respect to the operating position.

6. The applicating machine of claim 1 further comprising an outfeed providing unitized packages of containers from the operating position and a turner-diverter connected with the outfeed.

7. The applicating machine of claim 6 further comprising:

a conveyor extending through the turner-diverter, the conveyor having an adjustable height.

8. The applicating machine of claim 1 further comprising:

a reel stand positioned at the infeed conveyor, the reel stand moveable between a first position for accommodating a reel of carriers and a second position permitting placement of a carton of carriers relative to the infeed conveyor.

9. The applicating machine of claim 1 further comprising:

a platform positioned beneath the operating position of a respective jaw drum so that at least one of a vertical height and angle of the plurality of containers is adjustable relative to the operating position.

10. The applicating machine of claim 9 wherein the platform is adjustable to accommodate containers having heights between approximately 4 inches and approximately 12 inches.

11. The applicating machine of claim 1 wherein the first jaw drum includes a first pitch between adjacent jaw pairs of approximately 3" and the second jaw drum includes a second pitch between adjacent jaw pairs of approximately 2.6".

12. The applicating machine of claim 1 further comprising:

a pair of sidewalls positioned along the infeed conveyor, the sidewalls adjustable relative to each other.

13. The applicating machine of claim 12 further comprising:

a plurality of lugs extending along the pair of sidewalls.

14. An applicating machine for applying a flexible carrier to a plurality of containers provided from an infeed, the applicating machine comprising:

a jaw drum moveable between an operating position on the machine and a storage position on the machine, wherein in the operating position the jaw drum is positioned with respect to the infeed to accept the plurality of containers and stretch the flexible carrier over the plurality of containers; and a first track extending from the operating position;

a second track extending from the first track, the first track intersecting the second track at a junction, wherein the storage position of the jaw drum is on one side of the junction.

15. The applicating machine of claim 14 further comprising:

a second jaw drum moveable from at least one of the storage position and a second storage position to the operating position after the jaw drum has been removed therefrom.

16. The applicating machine of claim 15 wherein the jaw drum includes a different pitch between jaw pairs from the second jaw drum.

17. The applicating machine of claim 14 further comprising:

a rail for sliding the jaw drum relative to the operating position.

18. The applicating machine of claim 14 further comprising:

an outfeed conveyor providing unitized packages of containers from the operating position;

a turner-diverter connected with the outfeed conveyor; and a conveyor extending through the turner-diverter, the conveyor having an adjustable height.

19. The applicating machine of claim 14 further comprising:

a reel stand positioned at the infeed conveyor, the reel stand moveable between a first position for accommodating a reel of carriers and a second position permitting placement of a carton of carriers relative to the infeed conveyor.

20. A machine for packaging multiple containers in unitized packages, the machine comprising:

an operating position on the machine to accommodate a jaw drum for applying a first carrier to containers having a first size;

at least one storage position on the machine to accommodate at least one other jaw drum for applying a second carrier to containers having a second size; and a means to reconfigure the machine to slideably interchange the jaw drum with the at least one other jaw drum.

* * * * *